US008490428B2

(12) United States Patent
Blersch et al.

(10) Patent No.: US 8,490,428 B2
(45) Date of Patent: Jul. 23, 2013

(54) REFRIGERATOR AND/OR FREEZER

(75) Inventors: Dietmar Blersch, Ertingen (DE); Oliver Weidelener, Alleshausen (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 647 days.

(21) Appl. No.: 12/601,663

(22) PCT Filed: May 28, 2008

(86) PCT No.: PCT/EP2008/004252

§ 371 (c)(1),
(2), (4) Date: Nov. 24, 2009

(87) PCT Pub. No.: WO2008/145357

PCT Pub. Date: Dec. 4, 2008

(65) Prior Publication Data

US 2010/0170288 A1 Jul. 8, 2010

(30) Foreign Application Priority Data

May 30, 2007 (DE) ..... 20 2007 007 612 U
Sep. 24, 2007 (DE) ..... 20 2007 013 358 U

(51) Int. Cl.
*F25D 25/02* (2006.01)

(52) U.S. Cl.
USPC ..... 62/382; 62/441

(58) Field of Classification Search
USPC ..... 62/382, 441, 448, 449; 312/112, 312/402, 404, 408
See application file for complete search history.

(56) References Cited

U.S. PATENT DOCUMENTS

| | | | | |
|---|---|---|---|---|
| 5,251,974 | A * | 10/1993 | Beals | 312/330.1 |
| 5,540,492 | A * | 7/1996 | Dasher et al. | 312/404 |
| 5,609,252 | A * | 3/1997 | Koch | 206/455 |
| 5,641,217 | A * | 6/1997 | Caruso et al. | 312/404 |
| 5,788,094 | A * | 8/1998 | Kim et al. | 211/153 |
| 5,884,496 | A * | 3/1999 | Kim et al. | 62/186 |
| 6,363,738 | B2 * | 4/2002 | Nakajima et al. | 62/440 |
| 7,753,461 | B2 * | 7/2010 | Leistner et al. | 312/408 |
| 2001/0025508 | A1 * | 10/2001 | Nakajima et al. | 62/440 |
| 2002/0033657 | A1 | 3/2002 | Kim et al. | |
| 2003/0111943 | A1 * | 6/2003 | Banicevic et al. | 312/404 |

(Continued)

FOREIGN PATENT DOCUMENTS

| | | |
|---|---|---|
| BE | 355140 | 11/1928 |
| DE | 102004014464 | 10/2005 |
| DE | 102004019495 | 11/2005 |
| EP | 1775536 | 4/2007 |

*Primary Examiner* — Mohammad M Ali
(74) *Attorney, Agent, or Firm* — Dilworth & Barrese, LLP

(57) ABSTRACT

The present invention relates to a refrigerator and/or freezer with one or more storage trays for accommodating refrigerated and/or frozen goods, wherein the appliance includes one or more extensions which are connected with the storage trays and by means of which the storage trays can be pulled out of the appliance and be pushed into the same, wherein the extensions include first and second housing parts and a pull-out rail, wherein the pull-out rail comprises first and second parts which are movable relative to each other, wherein the first housing part is directly or indirectly connected with the first part of the pull-out rail and the second housing part is directly or indirectly connected with the second part of the pull-out rail, and wherein the first housing part is directly or indirectly connected with the storage tray and the second housing part is directly or indirectly connected with the refrigerator and/or freezer.

20 Claims, 2 Drawing Sheets

U.S. PATENT DOCUMENTS

| | | | | |
|---|---|---|---|---|
| 2003/0173882 | A1 | 9/2003 | Koons | |
| 2004/0065579 | A1* | 4/2004 | Wood | 206/545 |
| 2004/0164654 | A1* | 8/2004 | Laible | 312/122 |
| 2004/0174107 | A1* | 9/2004 | O'Halloran | 312/404 |
| 2004/0216481 | A1* | 11/2004 | James et al. | 62/344 |
| 2005/0120689 | A1* | 6/2005 | Kentner et al. | 55/507 |
| 2005/0143857 | A1* | 6/2005 | Chirnomas | 700/244 |
| 2005/0206287 | A1* | 9/2005 | House | 312/408 |
| 2005/0211721 | A1* | 9/2005 | Chirnomas et al. | 221/123 |
| 2005/0232820 | A1* | 10/2005 | Reed et al. | 422/100 |
| 2006/0091697 | A1* | 5/2006 | Rasmussen | 296/156 |
| 2007/0057609 | A1 | 3/2007 | Lam et al. | |

* cited by examiner

Fig. 3
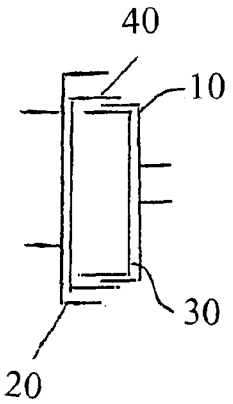
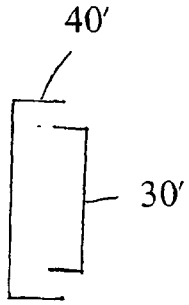
Fig. 4
Fig. 5
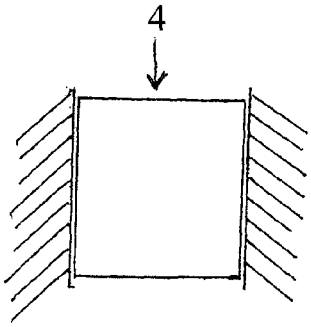
Fig. 6
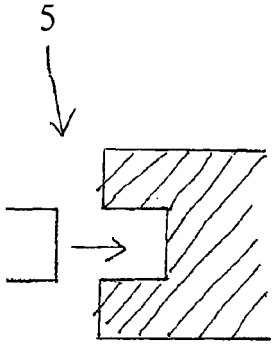
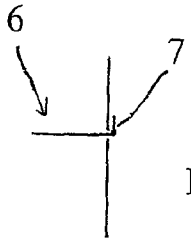
Fig. 7

REFRIGERATOR AND/OR FREEZER

The present invention relates to a refrigerator and/or freezer with one or more storage trays for accommodating refrigerated and/or frozen goods, wherein the appliance includes one or more extensions which are connected with the storage trays and by means of which the storage trays can be pulled out of the appliance and be pushed into the same.

A refrigerator and/or freezer with storage trays, which can be pulled out of the appliance and be pushed into the same by means of extensions, is known from DE 20 2005 016 883 U1. In this known arrangement, the extension consists of a first, stationary part, which rests for instance on a rib of the inner container, and of a second, movable part, which is connected with the storage tray. The connection of the storage tray with the second part of the extension is realized in that a tab is attached to the storage tray, which engages in the second, movable part of the extension.

SUMMARY OF THE INVENTION

It is the object underlying the present invention to develop a refrigerator and/or freezer as mentioned above in an advantageous way.

This object is solved by a refrigerator and/or freezer with the features herein.

Accordingly, it is provided that the extensions include first 10 and second 20 housing parts and a pull-out rail, wherein the pull-out rail comprises first 30 and second 40 parts which are movable relative to each other, wherein the first housing part 10 is directly or indirectly connected with the first part 30 of the pull-out rail and the second housing part 20 is directly or indirectly connected with the second part 40 of the pull-out rail, and wherein the first housing part 10 is directly or indirectly connected with the storage tray and the second housing part 20 is directly or indirectly connected with the refrigerator and/or freezer. In accordance with the invention, there is created a comparatively simply constructed arrangement of two housing parts 10, 20, which each are connected with one of the parts 30, 40 of the pull-out rail movable relative to each other and thus likewise are movable relative to each other. Furthermore, it is provided that one of the housing parts 10, 20 is connected with the storage tray and the other of the housing parts 10, 20 is mounted in the appliance interior, preferably on the inner container of the appliance. The housing parts 10, 20 can for instance be made of plastics and the pull-out rail can be made of metal. Other materials or pairs of materials can of course also be used.

BRIEF DESCRIPTION OF THE DRAWING

The drawings herein illustrate the refrigerator/freezer unit and the components forming the storage tray extensions of the present invention wherein:

FIG. 3 schematically illustrates a side view of the components forming the storage tray extensions:

FIG. 4 is a schematic side view showing a carriage and guideway;

FIG. 5 is a schematic side view showing a positive or frictional connection;

FIG. 6 is a schematic side view showing a latching or plug connection; and

FIG. 7 is a schematic side view showing a projection and web.

DESCRIPTION OF THE PREFERRED EMBODIMENTS

Figure 1:
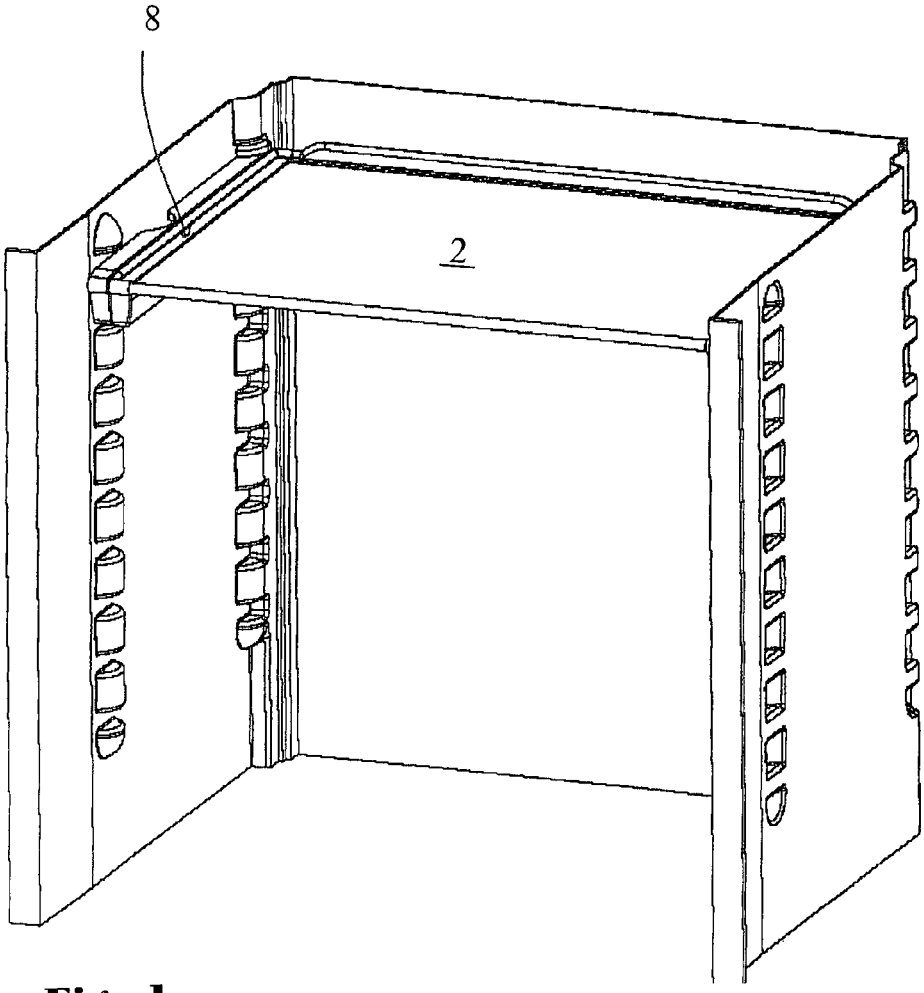
FIG. 1 illustrates a storage tray in an appliance.
Figure 2:
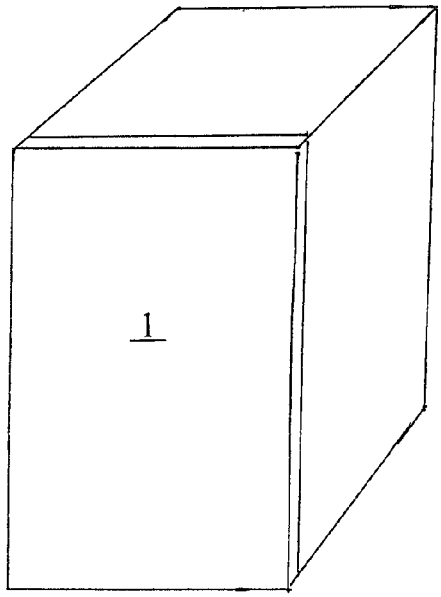
FIG. 2 is a schematic view of a refrigerator/freezer unit.

In a further aspect of the invention, one or both of the housing parts are releasably connected with each other and/or releasably connected with the pull-out rail. For instance, a latching or plug connection can be taken into consideration. Alternatively or in addition, it is conceivable that the first part 30 of the pull-out rail is releasably connected with the second part 40 of the pull-out rail. It is conceivable, for instance, that the pull-out rail consists of a guideway 40' and a carriage 30' movably accommodated therein, wherein the guideway 40' and the carriage 30' can be configured such that the carriage 30' can be removed from the guideway 40', if necessary, and preferably upon releasing a latch.

In a further aspect of the invention, it is provided that the housing parts are configured such that the pull-out rail is accommodated between the housing parts.

As explained above, the first or second part of the pull-out rail can be formed by a guideway, and the other of the parts can be formed by a carriage movably accommodated in the guideway.

The connection between the pull-out rail and the housing part(s) and/or the connection between the housing parts can be configured as a positive and/or frictional connection as shown in FIG. 5. It is conceivable to configure the connection as a latching or plug connection 5 as shown in FIG. 6, whereby a comparatively easy assembly is obtained, which preferably does not require any tool.

In a further aspect of the invention it is provided that one of the housing parts includes a receptacle extending in longitudinal direction thereof, into which one of the parts of the pull-out rail can be inserted.

Furthermore as shown in FIG. 7, it can be provided that one of the housing parts includes one or more projections 6, which engage in recesses in one of the parts of the pull-out rail. Of course, it is likewise conceivable to arrange the projections on the rail and the recesses on the housing part.

The projections 6 can be configured such that they include a web 7 which is arranged such that in the condition of the housing part mounted on the pull-out rail it engages behind the recess. It is conceivable to first introduce the projections into the recess and then fix the same in the recess by a shifting movement such that the web or webs engage behind the recess and thus safely fix the housing part on the pull-out rail.

Furthermore, it is particularly advantageous when the pull-out tray is releasably connected with the first housing part. A particularly easy assembly and disassembly and hence also the possibility of arranging the trays in different positions in the appliance interior is obtained when the second housing part is releasably arranged in the interior of the refrigerator and/or freezer, preferably releasably mounted on the inner container of the appliance. Preferably, the assembly and disassembly of the housing parts on the trays or in the appliance interior is possible without any tool.

The first housing part can include one or more receptacles 8 as shown in FIG. 1, into which the lateral edges of the storage trays are at least partly inserted. These receptacles 8 can for instance be configured as grooves. It can be provided that the length of the groove corresponds to the length of the lateral edge of the storage tray accommodated in the groove.

A particularly safe fixation of the storage tray is obtained when the groove is configured such that the lateral edge of the storage tray is positively accommodated in the groove on its upper and lower surfaces and/or on its front and back and/or on its end face. By means of such positive accommodation of the lateral edge of the storage tray, the same is fixed on the housing of the extension in a simple way and is secured there against being shifted relative to the housing. Alternatively or in addition, it is of course also possible to realize a frictional connection between the storage tray and the housing part.

This invention furthermore relates to a refrigerator and/or freezer with one or more storage trays for accommodating refrigerated and/or frozen goods, wherein the appliance includes one or more extensions which are connected with the storage trays and by means of which the storage trays can be pulled out of the appliance and be pushed into the same. The appliance is characterized in that the extensions include one or more receptacles, into which the lateral edges of the storage trays are at least partly inserted.

The receptacle can be configured in accordance with the description herein.

Preferably, it is provided that the storage trays are releasably connected with the extensions and/or the extensions are releasably connected with the appliance and/or the extensions include parts releasable from each other.

Further details and advantages of the invention will be explained in detail with reference to an embodiment described below.

In accordance with the embodiment described here, the refrigerator and/or freezer includes storage trays which are connected with extensions by means of which the storage trays can be pulled out of the appliance interior and can be pushed into the same. The extensions consist of a pull-out rail and of first 10 and second 20 housing parts, wherein the pull-out rail is made of metal and the housing parts 10, 20 are made of plastics. Other materials can of course also be used.

The pull-out rail itself is made of at least two parts 30, 40, one 30 of which represents a guideway and another one 40 represents a carriage or the like, which is movably accommodated in the guideway 30.

The first housing part 10 is configured such that it includes a receptacle for the guideway 30 of the pull-out rail, which is configured such that the guideway can be inserted into the pull-out rail in longitudinal direction thereof.

The second housing part 20 includes one or more projections which serve to mount the second housing part 20 on said carriage 40 of the pull-out rail. For this purpose, the carriage includes one or more recesses, which are dimensioned such that in the mounted condition the projections engage in the recesses. The projections are provided with one or more webs or the like, which are arranged such that in the mounted condition they engage behind the recesses. It can be provided that the webs are arranged such that the projections first are inserted in the recesses and then the second housing part is moved relative to the carriage such that the webs engage behind the recess as mentioned above.

Of course, it is likewise conceivable to configure the type of attachment identical for the two housing parts or also opposite to the above representation, i.e. to configure the guideway with said recesses and insert the carriage into the housing part.

In the embodiment described here, both housing parts are releasably connected with the guideway or the carriage of the pull-out rail. In principle, however, it is likewise conceivable to configure both or one of these connections unreleasable.

In the first housing part, a groove-like receptacle is provided, whose length corresponds to the length of the lateral edge of the storage tray. For mounting the first housing part on the storage tray, first housing parts are pushed onto the lateral edges of the storage tray on both sides, wherein the groove-like receptacles in the first housing parts are configured such that the lateral edges are positively accommodated.

A relative movement between storage tray and first housing part is prevented in that the groove of the first housing part extends not only on the upper and lower surfaces, but also on the front and back of the lateral edge of the storage tray, so that the same including the end face is surrounded by groove walls on five sides.

The assembly now is mounted on the inner container of the appliance. For this purpose, the second housing parts are placed on ribs or other suitable fastening elements of the inner container, wherein the second housing parts are configured such that they are secured against unintentional withdrawal. Mounting the housing parts on the pull-out rail, mounting the first housing part on the storage tray, and mounting the second housing part in the interior of the appliance preferably is possible without the aid of a tool.

The invention claimed is:

1. A refrigerator and/or freezer with one or more storage trays for accommodating refrigerated and/or frozen goods, wherein the refrigerator and/or freezer includes one or more extensions, said extensions being connected with the storage trays and by which the storage trays can be pulled out of the appliance and be pushed into the same, the extensions include first (10) and second (20) housing parts and a pull-out rail, the pull-out rail includes first (30) and second (40) parts, said first (30) and second (40) parts being movable relative to each other, the first housing part (10) is directly or indirectly connected with the first part (30) of the pull-out rail and the second housing part (20) is directly or indirectly connected with the second part (40) of the pull-out rail, and the first housing part (10) is directly or indirectly connected with the storage tray and the second housing (20) part is directly or indirectly connected with the refrigerator and/or freezer.

2. The refrigerator and/or freezer according to claim 1, wherein one or both of the housing parts are releasably connected with each other and/or releasably connected with the pull-out rail.

3. The refrigerator and/or freezer according to claim 1, wherein the first part of the pull-out rail is releasably connected with the second part of the pull-out rail.

4. The refrigerator and/or freezer according to claim 1, wherein the housing parts are configured such that the pull-out rail is accommodated between the housing parts.

5. The refrigerator and/or freezer according to claim 1, wherein the first or second part of the pull-out rail is formed by a guideway and the other one of the parts is formed by a carriage movably accommodated in the guideway.

6. The refrigerator and/or freezer according to claim 1, wherein the connection between the pull-out rail and the housing part(s) and/or the connection between the housing parts is configured as a positive and/or frictional connection.

7. The refrigerator and/or freezer according to claim 1, wherein the connection of the housing parts with the pull-out rail or the connection of the housing parts with each other is configured as a latching or plug connection.

8. The refrigerator and/or freezer according to claim 1, wherein one of the housing parts includes a receptacle extending in longitudinal direction thereof, into said receptacle one of the parts of the pull-out rail can be inserted.

9. The refrigerator and/or freezer according to claim 1, wherein one of the housing parts includes one or more projections which engage in recesses in one of the parts of the pull-out rail.

10. The refrigerator and/or freezer according to claim 9, wherein the projections include a web arranged to engage behind the recess of the pull out rail when the housing part is mounted on the pull-out rail.

11. The refrigerator and/or freezer according to claim 1, wherein the pull-out rail is releasably connected with the first housing part.

12. The refrigerator and/or freezer according to claim 1, wherein the second housing part is releasably arranged in the interior of the refrigerator and/or freezer, preferably releasably arranged on the inner container of the appliance.

13. The refrigerator and/or freezer according to claim 1, wherein the first housing part includes one or more receptacles into which receptacles the lateral edges of the storage trays are at least partly inserted.

14. The refrigerator and/or freezer according to claim 13, wherein the receptacle is configured as a groove.

15. The refrigerator and/or freezer according to claim 14, wherein the length of the groove corresponds to the length of the lateral edge of the storage tray accommodated in the groove.

16. The refrigerator and/or freezer according to claim 14, wherein the groove is configured such that on its upper and lower surfaces and/or on its front and back and/or on its end face the lateral edge of the storage tray is positively accommodated in the groove.

17. A refrigerator and/or freezer with one or more storage trays for accommodating refrigerated and/or frozen goods, wherein the refrigerator and/or freezer includes one or more extensions, said extensions being connected with the storage trays and by the extensions the storage trays can be pulled out of the appliance and be pushed into the same, and the extensions include one or more receptacles and into the receptacles the lateral edges of the storage trays are at least partly inserted.

18. The refrigerator and/or freezer according to claim 17, wherein the receptacle is configured as a groove.

19. The refrigerator and/or freezer according to claim 17, wherein the storage trays are releasably connected with the extensions and/or the extensions are releasably connected with the appliance and/or the extensions include parts releasable from each other.

20. The refrigerator and/or freezer according to claim 2, wherein the first part of the pull-out rail is releasably connected with the second part of the pull-out rail.

* * * * *